US006336788B1

(12) United States Patent
Fujii et al.

(10) Patent No.: US 6,336,788 B1
(45) Date of Patent: Jan. 8, 2002

(54) REGENERATIVE TYPE PUMPS

(75) Inventors: Shinichi Fujii; Seiji Murase, both of Obu (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 09/576,343

(22) Filed: May 22, 2000

(30) Foreign Application Priority Data

May 20, 1999 (JP) ..... 11-140311

(51) Int. Cl.[7] ..... F04D 5/00
(52) U.S. Cl. ..... 415/55.1; 415/55.4
(58) Field of Search ..... 415/55.1, 55.2, 415/55.3, 55.4, 55.5

(56) References Cited

U.S. PATENT DOCUMENTS

| | | | | |
|---|---|---|---|---|
| 5,498,124 A | * | 3/1996 | Ito et al. | 415/55.1 |
| 5,558,490 A | | 9/1996 | Dobler et al. | |
| 5,785,490 A | | 7/1998 | Dobler et al. | |
| 6,010,301 A | * | 1/2000 | Oi et al. | 415/55.2 |
| 6,017,183 A | * | 1/2000 | Dobler et al. | 415/55.1 |
| 6,068,456 A | * | 5/2000 | Tuckey et al. | 417/423.3 |

FOREIGN PATENT DOCUMENTS

| | | |
|---|---|---|
| EP | 0609877 | 8/1994 |
| JP | 03018688 | 1/1991 |
| JP | 06288381 | 10/1994 |

* cited by examiner

*Primary Examiner*—Edward K. Look
*Assistant Examiner*—Ninh Nguyen
(74) *Attorney, Agent, or Firm*—Dennison, Scheiner Schultz & Wakeman

(57) ABSTRACT

An impeller 16 has a plurality of blade grooves 16*a* formed along a perimeter thereof. A pump casing 17 has an inlet port 22, a discharge port 24, a first circumferential groove 20 contiguous with the inlet port 22, a second circumferential groove contiguous with the discharge port 24 and a partition 25 between a groove inlet portion 23 and the discharge port 24. An opening end face of the discharge port 24 on the side of the pump casing 17 that faces the impeller has a tapered portion 24*a* and a damping portion 24*b*. The tapered portion 24*a* has an opening width W that gradually decreases along the direction of rotation of the impeller 16. The damping portion 24*b* has an opening width that is substantially constant along the direction of rotation of the impeller. In one embodiment, a corner portion, which is defined by wall surfaces 24*c*, 24*d* defining the tapered portion 24*a* and the damping portion 24*b* of the discharge port 24, respectively, and a lower surface 9*a* of the pump casing 17, is chamfered.

14 Claims, 8 Drawing Sheets

REGENERATIVE TYPE PUMPS

BACKGROUND OF THE INVENTION

1. Field of the Invention

The present invention relates to pumps, and more particularly, to regenerative type pumps, which are also known as Wesco pumps.

2. Description of the Related Art

An example of a regenerative type pump is disclosed in Japanese Laid-Open Patent Publication No. 3-18688 and has an impeller rotatably disposed within a pump casing. The pump casing has an inlet port and a discharge port, both of which are fixed in position on opposite sides of the impeller. A plurality of blade grooves are formed along the perimeter of the impeller. Fluid is drawn through the inlet port by the impeller and discharged through the discharge port along a travelling path of the impeller blade grooves. The upper portion of the pump casing has a groove beginning with a groove inlet portion and ending with the discharge port. A partition is formed between the groove inlet portion and the discharge port and the partition forms a terminal end of the fluid path within the pump casing.

In such a regenerative type pump, if some of the high-pressure fluid collides with the terminal end of the fuel path without being smoothly discharged through the discharge port, high frequency noise is generated.

In order to reduce such noise in the terminal end of the fluid path, Japanese Laid-Open Patent Publication No. 6-288381 discloses a regenerative type pump in which an opening end face of the discharge port that faces the impeller has an opening width that gradually decreases along the direction of rotation of the impeller. In this publication, the inventors allege that fluid will smoothly pass through the passage and gradually contact a wall surface that defines the opening end face having the gradually tapered opening. Therefore, the inventors stated that noises caused by such collisions are reduced. However, based upon experiments performed by the Applicant, even in this regenerative type pump, some of the high-pressure fluid still collides with the terminal end passage on the downstream side of the discharge port. Therefore, this known pump does not significantly reduce noise generated in the termination of the fluid passage.

SUMMARY OF THE INVENTION

It is, accordingly, an object of the present invention to teach improved regenerative type pumps. Preferably, such improved regenerative type pumps generate less noise than known pumps.

In one aspect of the present teachings, regenerative type pumps are constructed such that the fluid is smoothly discharged from the discharge port and the amount of high-pressure fluid that collides against the terminal end of the discharge port is minimized.

In another aspect of the present teachings, a groove of substantially constant width is circumferently formed within an inner pump cover on the side of the inner pump cover that faces the impeller. The groove begins with a groove inlet portion, ends with the discharge port and a partition is disposed between the groove inlet portion and the discharge port.

Preferably, the opening portion of the discharge port has a tapered portion and a damping portion. The tapered portion has an opening width that gradually decreases in the circumferential direction. The damping portion is contiguous with the tapered portion and has an opening width that is substantially constant in the circumferential direction. This design allows high-pressure fluid to be smoothly delivered to and discharged from the discharge port. Therefore, the amount of high-pressure fluid that collides with the terminal end of the discharge port is decreased and pump noise can be reduced.

A corner portion may exist between the wall surfaces of the tapered portion and the damping portion of the discharge port and a lower surface of the inner pump cover. In one embodiment, this corner portion is chamfered to permit fluid to smoothly flow from the tapered portion to the damping portion. As a result, the fluid flow rate is not abruptly decreased in the terminal end of the tapered portion and pump noise can be further reduced.

A front wall surface of the discharge port, which can be disposed forward in the direction of rotation of the impeller, preferably includes an oblique surface that forms an acute angle with the lower surface of the inner pump cover. Thus, the fluid can smoothly flow into the discharge port along the oblique surface, so that the pump efficiency can be enhanced. Further, the discharge port can be easily manufactured by injection molding, due to the oblique configuration of the front wall surface of the discharge port.

Further, a rear wall surface may be located in the discharge port and rearward in the direction of rotation of the impeller. This rear wall surface preferably includes an oblique surface that forms an acute angle with the lower surface of the inner pump cover. Thus, the fluid can smoothly flow into the discharge port, so that the pump efficiency can be enhanced.

Additional objects, features and advantages of the present invention will be readily understood after reading the following detailed description together with the accompanying drawings and the claims.

DETAILED DESCRIPTION OF THE INVENTION

Regenerative type pumps generally include an impeller having a plurality of blade grooves formed along a perimeter of the impeller. The impeller is rotatably supported within a pump casing, which may comprise an outer pump cover having a fluid inlet port and an inner pump cover having a discharge port. Fluid can pass from the inlet port through the impeller and to the inner pump cover. The inner pump cover may include a fluid groove that circumferentially extends from a groove inlet portion to the discharge port and corresponds to the circular travelling path of the impeller blade grooves. A partition is typically formed between the groove inlet portion and the discharge port.

Preferably, an opening end face of the side of the discharge port that faces the impeller has a tapered portion and a damping portion. The tapered portion preferably has an opening width that gradually decreases in the circumferential direction. The damping portion is preferably contiguous with a downstream side of the tapered portion and has an opening width that is substantially constant in the circumferential direction.

A corner portion may exist between the wall surfaces defining the tapered portion and the damping portion of the discharge port and a lower surface of the inner pump cover. Preferably, this corner portion is chamfered. More preferably, the chamfering angle is between about 25° to 50°.

The discharge port may have a front wall surface located forward in the circumferential direction, which front wall surface may have an oblique surface that forms an acute angle with the lower surface of the inner pump cover.

The discharge port may have a rear wall surface that is located rearward in the direction of rotation of the impeller and includes an oblique surface that forms an acute angle with the lower surface of the inner pump cover.

Each of the additional features and method steps disclosed above and below may be utilized separately or in conjunction with other features and method steps to provide improved Regenerative type pumps and methods for designing and using such pumps. Representative examples of the present invention, which examples utilize many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention.

First Embodiment

Figure 1:
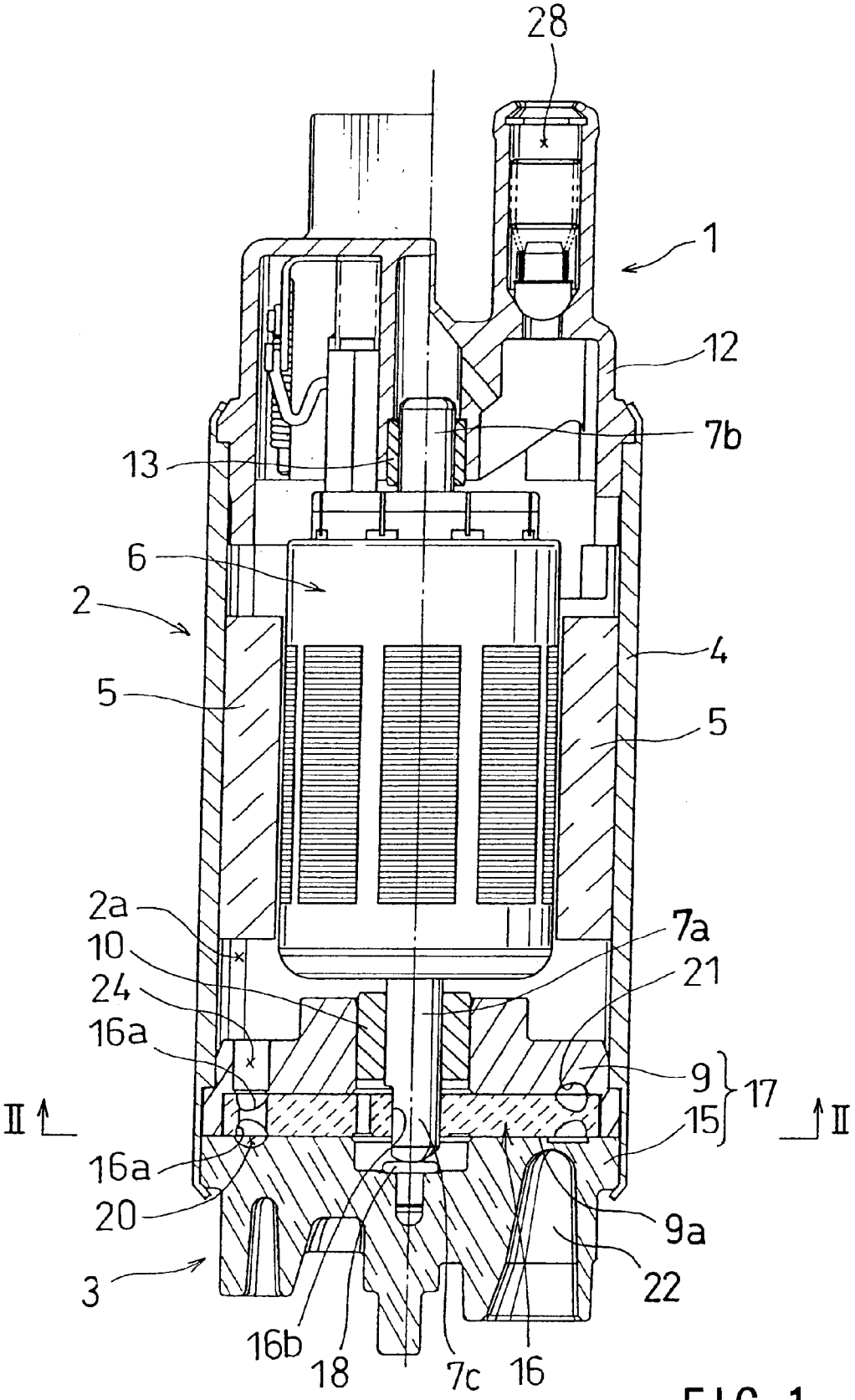
FIG. 1 is a sectional view of a representative generative type pump.

FIG. 1 is a sectional view of a first representative embodiment, showing a fuel pump 1 for supplying fuel to a vehicle engine having a fluid inlet portion 3 and a motor receiving portion 2. Preferably, a brush-type direct current motor is disposed within the motor receiving portion 2 and includes a magnet 5 coaxially disposed within a pump housing 4. A rotor 6 is coaxially disposed within the magnet 5. Bearing 10 rotatably supports a lower end portion 7*a* of a rotor shaft 7, which is disposed within an inner pump cover 9. The inner pump cover 9 is fixedly attached to the lower end of the pump housing 4. An upper end portion 7*b* of the shaft 7 is rotatably supported by a bearing 13 disposed within a motor cover 12. The motor cover 12 is fixedly attached to the upper end of the pump housing 4. By supplying electric current to a rotor coil (not shown) via a terminal (not shown) provided on the motor cover 12, the rotor 6 and thus the shaft 7 will rotate. Because motors that are capable of driving a fuel pump are well known in the art, further detailed description is not necessary. However, it should be noted that the motor is not limited to a brush-type direct current motor, but rather, various types of motors may be used with the present teachings.

Figure 2:
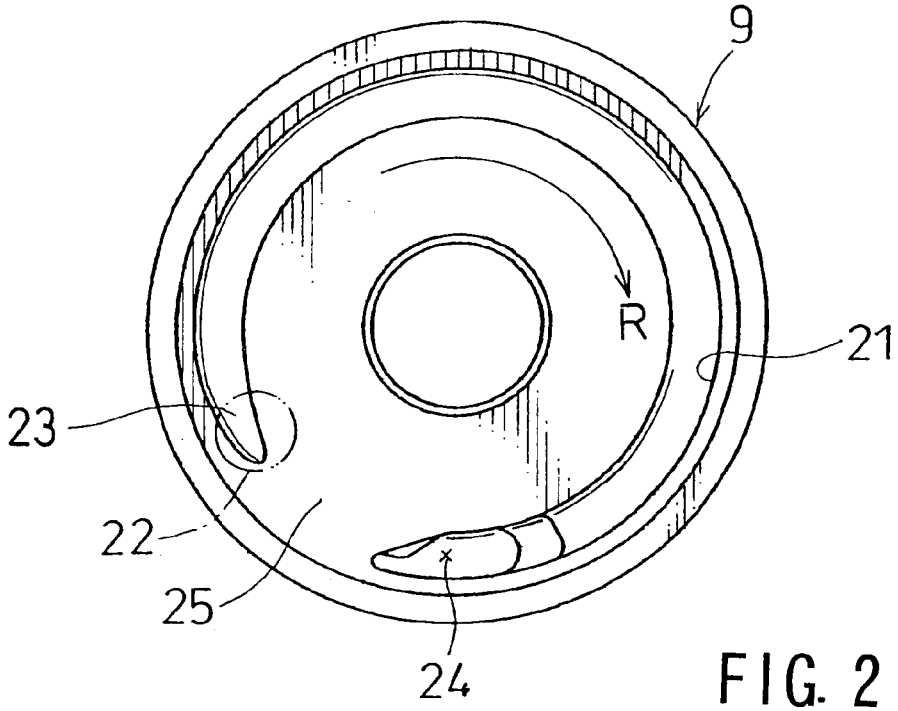
FIG. 2 is a view of a first representative inner pump cover 9 as viewed from the side of the inner pump cover 9 that faces the impeller 16.
Figure 3:
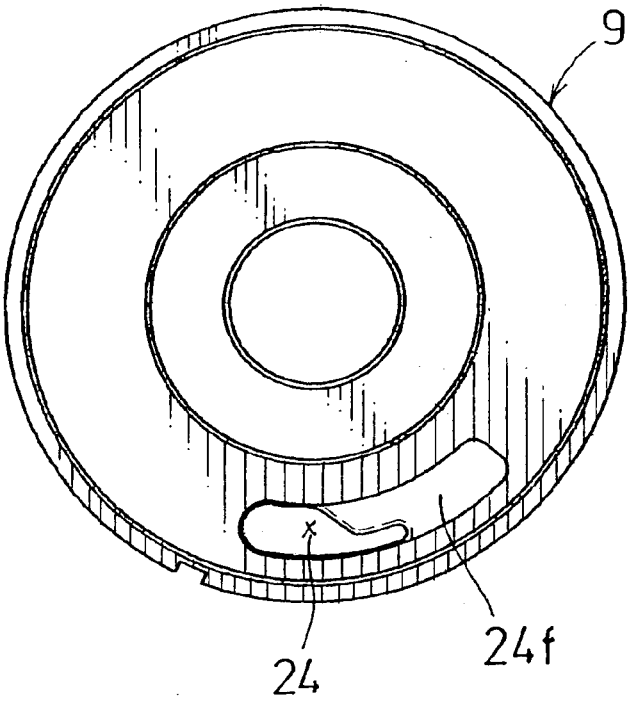
FIG. 3 is a view of the inner pump cover 9 from the opposite side of the side shown in FIG. 2.
Figure 4:
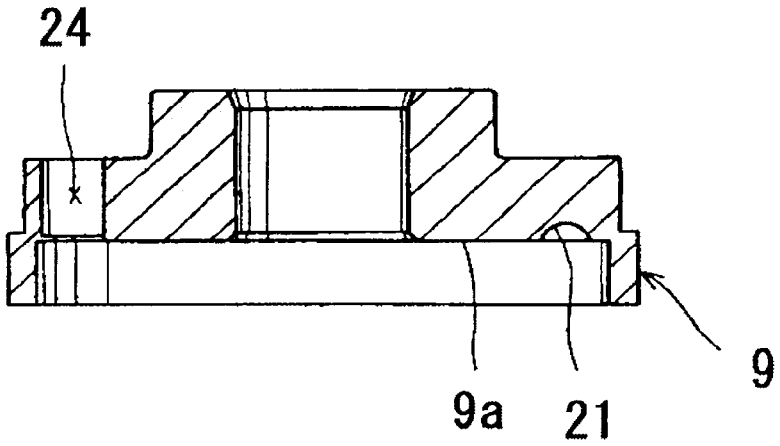
FIG. 4 is a cross-sectional view of the inner pump cover 9.

The fluid inlet portion 3 preferably includes the inner pump cover 9, an outer pump cover 15 and an impeller 16 disposed between the inner pump cover 9 and the outer pump cover 15. The inner pump cover 9 and the outer pump cover 15 may be formed, for example, of die-cast aluminum. FIG. 2 shows an inner view of side of the inner pump cover 9 that go faces the impeller 16. FIG. 3 is a view of the opposite side of the inner pump cover 9. FIG. 4 is a cross-sectional view of the inner pump cover 9.

The outer pump cover 15 may be secured, for example by caulking, to the lower end of the pump housing 4. The outer pump cover 15 is thus fixed in position with respect to the inner pump cover 9. A thrust bearing 18 is preferably fixed in the center of the outer pump cover 15 in order to receive the thrust load of the rotor shaft 7. The inner pump cover 9 and the outer pump cover 15 form a pump casing 17. As noted above, the impeller 16 is rotatably disposed within the pump casing 17.

The impeller 16 is preferably molded from a resin and has a plurality of blade grooves 16*a* along the perimeter of the impeller 16. The blade groove 16*a* may be of any form that will communicate fluid from the inlet port 22 in the outer pump cover 15 to the discharge port 24 in the inner pump cover 9, such as the blade grooves 16*a* taught in WO 99/07990 and US patent application Ser. No. 09/269,739, which are hereby incorporated by reference. The impeller 16 may comprise a generally D-shaped engagement center hole 16*b* and the engagement stem portion 7*c* of the lower shaft portion 7*a* may have a corresponding D-shaped portion. By tightly fitting the engagement stem portion 7*c* within the engagement center hole 16*b*, the impeller 16 is connected to the shaft 7. As a result, the impeller 16 will together rotate with the shaft 7.

As shown in FIGS. 1, 2 and 4, a groove 21 is preferably formed in the circumferential direction of the inner pump cover 9. Similarly, as shown in FIG. 1, a groove 20 also may be formed in the circumferential direction of the outer pump cover 15. Both grooves 20 and 21 face the impeller 16 and are formed along the travelling path of the blade grooves 16*a* of the impeller 16.

As shown in FIG. 1, an inlet port 22 is preferably formed in the outer pump cover 15 and a discharge port 24 is formed in the inner pump cover 9. Fluid is communicated between the inlet port 22 and the discharge port 24 by means of the grooves 20 and 21 and the blade grooves 16*a* of the rotating impeller 16. As shown in FIG. 2, a partition 25 is preferably formed between a groove inlet portion 23 and the discharge port 24 and serves to prevent back flow of fuel. A broken-line circle in FIG. 2 shows a preferred position of the inlet port 22 with respect to the groove inlet portion 23 and the discharge port 24. That is, the inlet port 22 of the outer pump cover 15 is preferably disposed proximal to the groove inlet portion 23 of the inner pump cover 4.

As shown in FIG. 1, the discharge port 24 extends through the inner pump cover 9 and communicates with an inner space 2*a* of the motor receiving portion 2.

Figure 5:
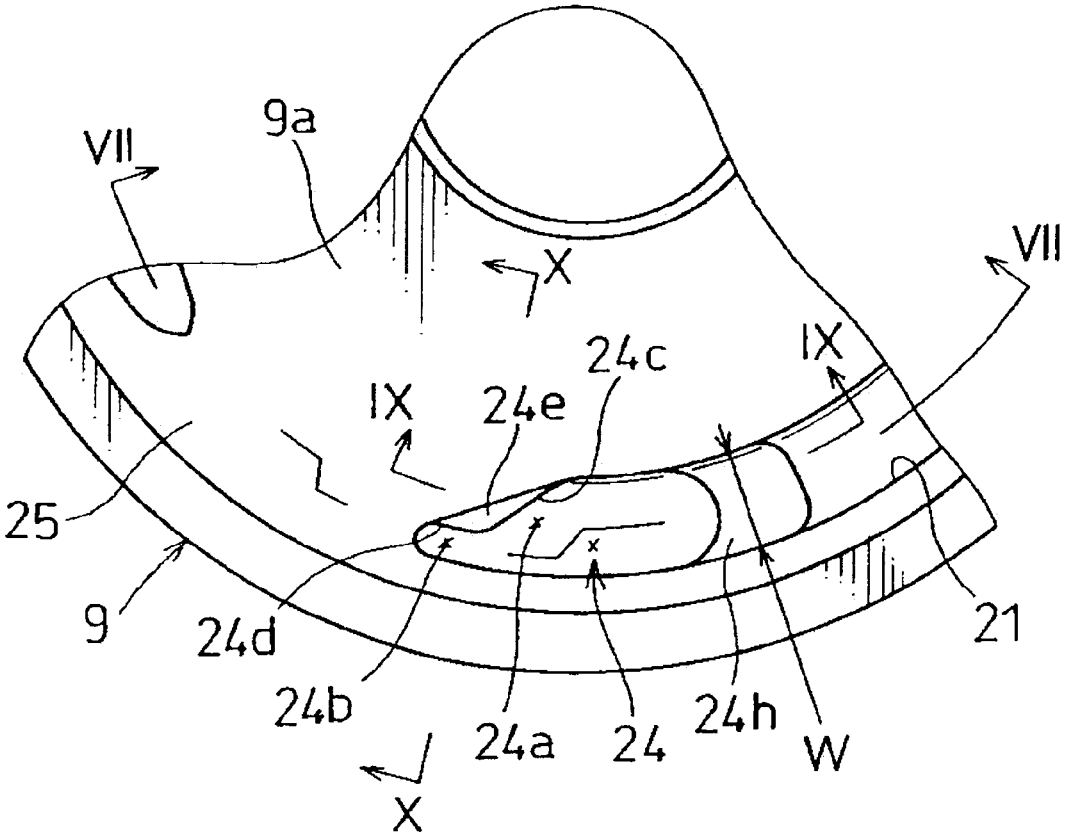
FIG. 5 is an enlarged view of the discharge port 24 shown in FIG. 2.
Figure 6:
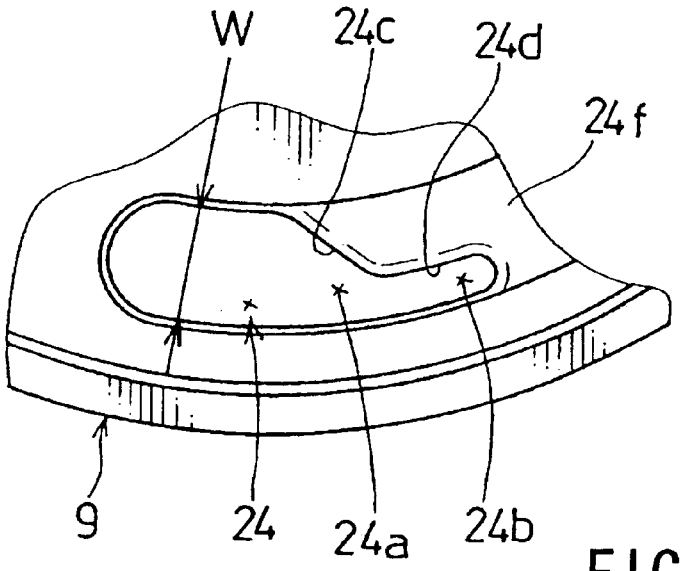
FIG. 6 is an enlarged view of the opposite side of the discharge port that is shown in FIG. 3.
Figure 7:
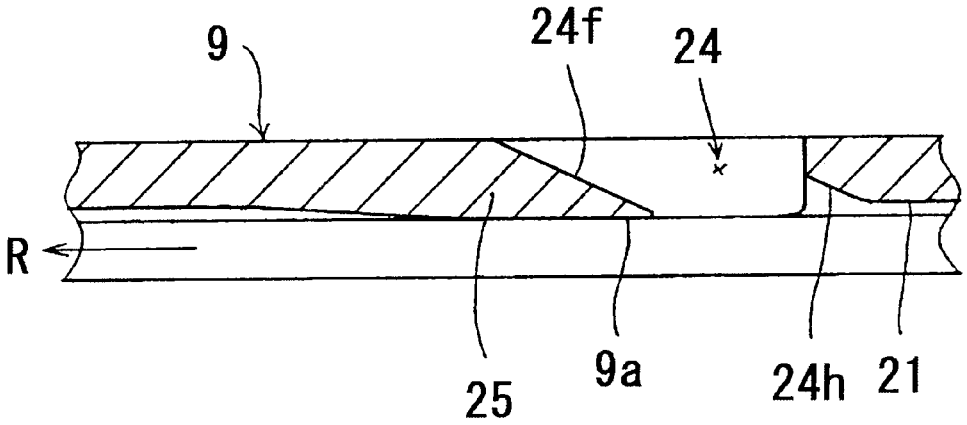
FIG. 7 is a cross-sectional view taken along line VII—VII shown in FIG. 5.

A preferred design for the discharge port 24 will now be explained with reference to FIGS. 5 to 10. An opening end face of the side of the discharge port 24 that faces the impeller 16 preferably has a shape as shown in FIGS. 2 and 5. Specifically, the opening end face of the discharge port 24 that faces the impeller 16 has a tapered portion 24*a* and a damping portion 24*b*. The tapered portion 24*a* is contiguous with the downstream end of the fluid groove 21 and has an opening width W that gradually decreases in the circumferential direction towards the discharge port 24. The damping portion 24*b* is contiguous with the downstream side of the tapered portion 24*a* and has an opening width W that is substantially constant.

Figure 9:
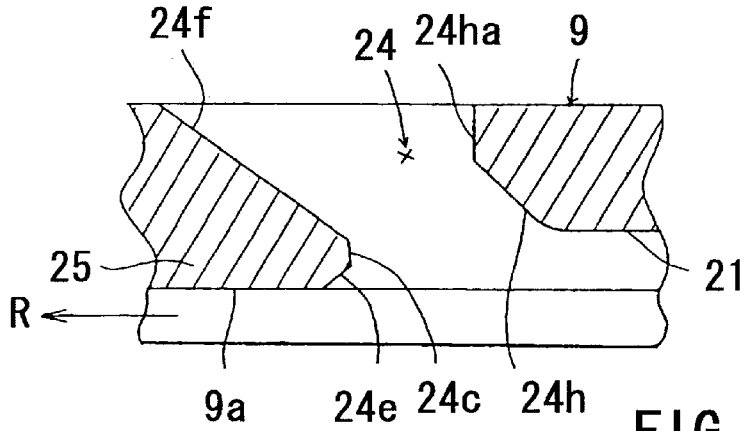
FIG. 9 is a cross-sectional view taken along line IX—IX shown in FIG. 5.
Figure 10:
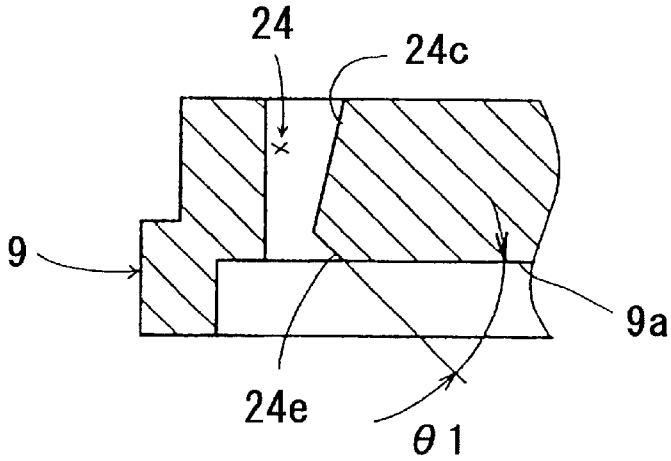
FIG. 10 is a cross-sectional view taken along line X—X shown in FIG. 5.

As shown in FIGS. 5, 9 and 10, a corner portion 24*e* is formed at the intersection of wall surface 24*c* of the tapered portion 24*a*, wall surface 24*d* of the damping portion 24*b* and a lower surface 9*a* of the inner pump cover 9, which lower surface 9*a* faces the impeller 16. In this representative embodiment, the corner portion 24*e* is chamfered at a chamfering angle θ1 with respect to the radial direction of the lower surface 9*a*, as shown in FIG. 10.

Figure 8:
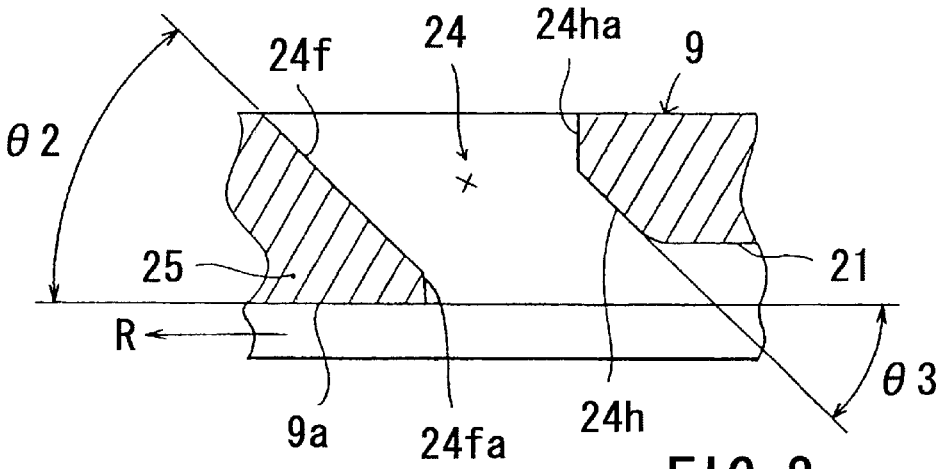
FIG. 8 is an enlarged view of FIG. 7.

Further, as shown in FIG. 8, a front wall surface 24*f* of the discharge port 24 is located forward in the direction of rotation of the impeller 16. Preferably, the front wall surface 24*f* forms an acute angle θ2 with the lower surface 9*a* of the inner pump cover 9. The angle θ2 is the angle formed by the front wall surface 24*f* and the lower surface 9*a* with respect to the direction of rotation of the impeller 16. An oblique surface 24*fa* is formed in the front end of the front wall surface 24*f* of the discharge port 24 and is preferably perpendicular to the lower surface 9*a*. Thus, the front end of the front wall surface 24*f* does not have a pointed edge, which improves the durability of that portion of the inner pump cover 9.

Further, as shown in FIG. 8, a rear wall surface 24*h* is located rearward of the discharge port 24 in the direction of rotation of the impeller 16. Preferably, the rear wall surface also forms an acute angle θ3 with the lower surface 9*a*. The angle θ3 is an angle of the lower surface 9*a* with respect to the direction of rotation of the impeller 16. An oblique surface 24*ha* is formed in the rear end of the rear wall surface 24*h* and is preferably perpendicular to the lower surface 9*a*. Thus, the rear end 24*ha* of the rear wall surface 24*h* also does not have a pointed edge, thereby improving the durability of that portion of the inner pump cover 9.

A representative method for operating the fluid pump shown in FIGS. 1–10 will now be explained. When the rotor 6 rotates, the impeller 16 that is connected to the shaft 7 of the rotor 6 rotates in the direction shown by arrow R in FIGS. 2 and 7. Thus, the blade grooves 16*a* formed in the impeller 16 also rotate. Fluid, e.g. fuel from a fuel tank, is drawn into the inlet port 22 by the rotating impeller blades 16*a*, is discharged through the discharge port 24, passes through the inner space 2*a* of the motor receiving portion 2 and is exhausted at high pressure from the delivery port 28 formed in the motor cover 12. The fluid may be fuel that is supplied to a fuel injector (not shown).

In this embodiment, the opening end face of the discharge port 24 on the side of the inner pump cover 9 that faces the impeller 16 has the tapered portion 24*a* and the damping portion 24*b*. The tapered portion 24*a* is contiguous with the fluid groove 21 and has an opening width W that gradually decreases along the direction of rotation of the impeller 16. The damping portion 24*b* is contiguous with the tapered portion 24*a* and has an opening width W that is substantially constant along the direction of rotation of the impeller 16. Accordingly, most of the pressurized fuel that has been delivered to the discharge port 24 smoothly flows through the tapered portion and the damping portion of the opening end face of the discharge port 24 and is discharged from the discharge port 24 to the inner space 2*a* of the motor receiving portion 2. Therefore, the amount of high-pressure fluid that collides with a terminal end passage on the downstream side of the discharge port 24 is decreased, thereby reducing pump noise.

Further, the chamfered corner portion 24*e* permits fuel to smoothly flow from the tapered portion 24*a* to the damping portion 24*b* of the opening end face of the discharge port 24. Thus, pump noise can be further reduced.

In addition, the front wall surface 24*f* of the discharge port 24 can be formed at an acute angle with respect to the lower surface 9*a* of the inner pump cover 9 to permit the fuel to smoothly flow into the discharge port 24. Thus, pump efficiency can be enhanced.

Figure 11:
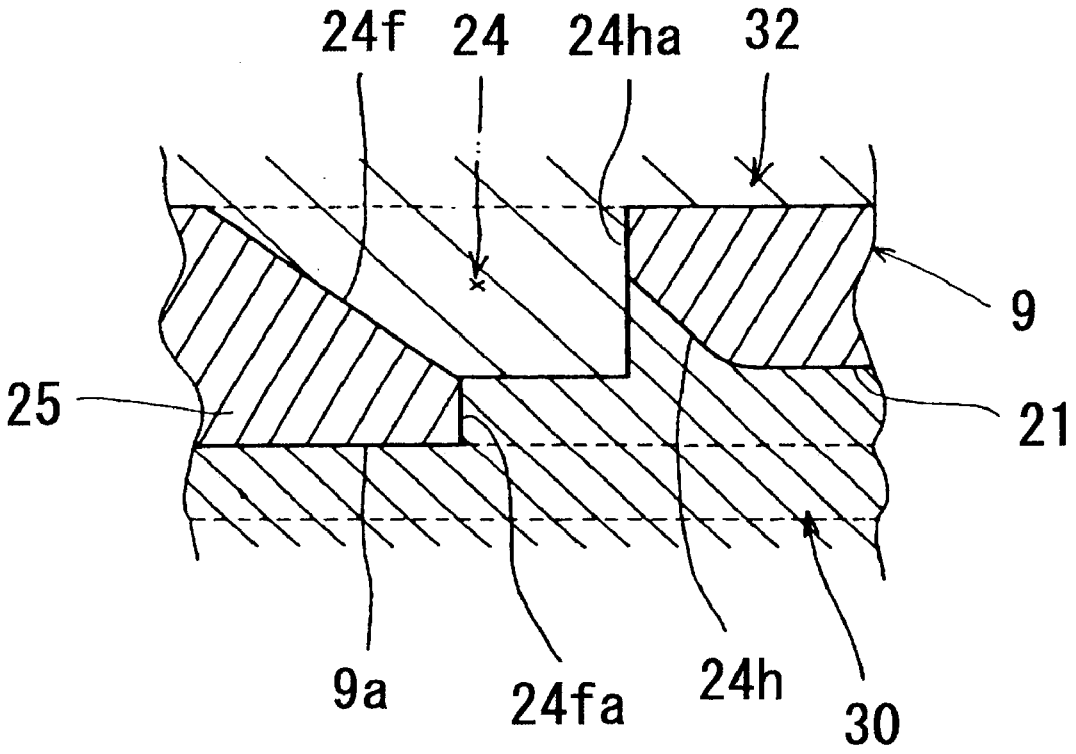
FIG. 11 is a partial cross-sectional view of representative molding dies that can be utilized to mold inner pump cover 9.

Finally, the discharge port 24 can be easily manufactured by injection molding the obliquely formed front wall surface 24*f* of the discharge port 24. FIG. 11 is a partial cross-sectional view of representative molding dies for molding the inner pump cover 9 by using, for example, an upper die 30 and a lower die 32. Because the front wall surface 24*f* of the discharge port 24 includes an oblique surface, the upper die 30 and the lower die 32 can be readily removed after forming the inner pump cover 9.

Second Embodiment

Figure 12:
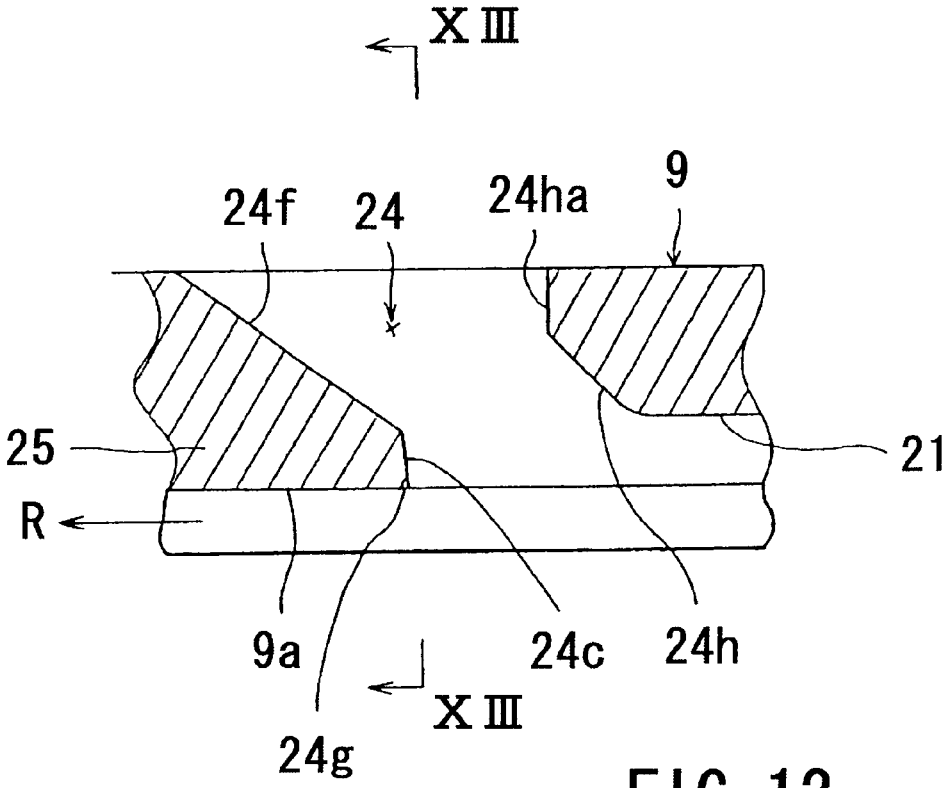
FIG. 12 is a partial cross-sectional view of a second representative pump cover.
Figure 13:
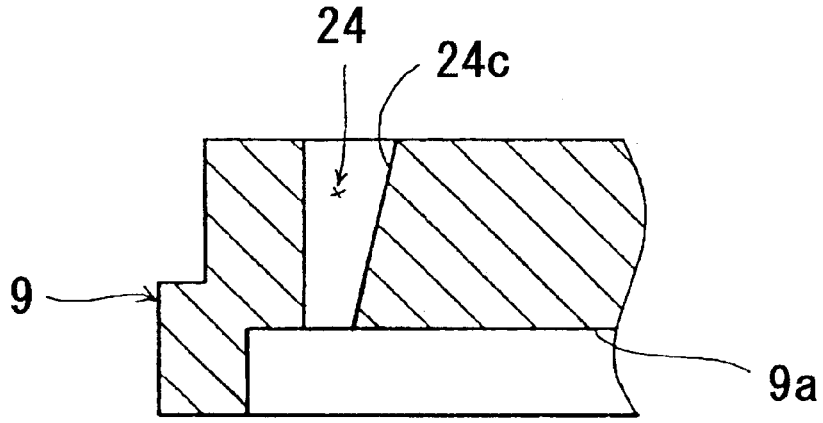
FIG. 13 is a cross-sectional view taken along line XIII—XIII shown in FIG. 12.

A second representative embodiment will now be explained with reference to FIGS. 12 and 13, which is a modification of the first representative embodiment. Thus, only the modified portions of the first representative embodiment will be discussed in detail and components that are identical to or equivalent to components in the first embodiment will be identified by the same numerals as in the first embodiment.

In the second representative embodiment, a corner portion 24*g* is defined by wall surface 24*c* of the tapered portion 24*a*, wall surface 24*d* of the damping portion 24*b* of the discharge port 24 and the lower surface 9*a* of the inner 10 pump cover 9. In this embodiment the corner portion 24*g* is not chamfered. While the chamfered surface 24*e* (see FIGS. 5, 8 and 9) of the first representative embodiment is not provided, pump noise can still be reduced over known pumps.

EXPERIMENTAL RESULTS

Figure 14:
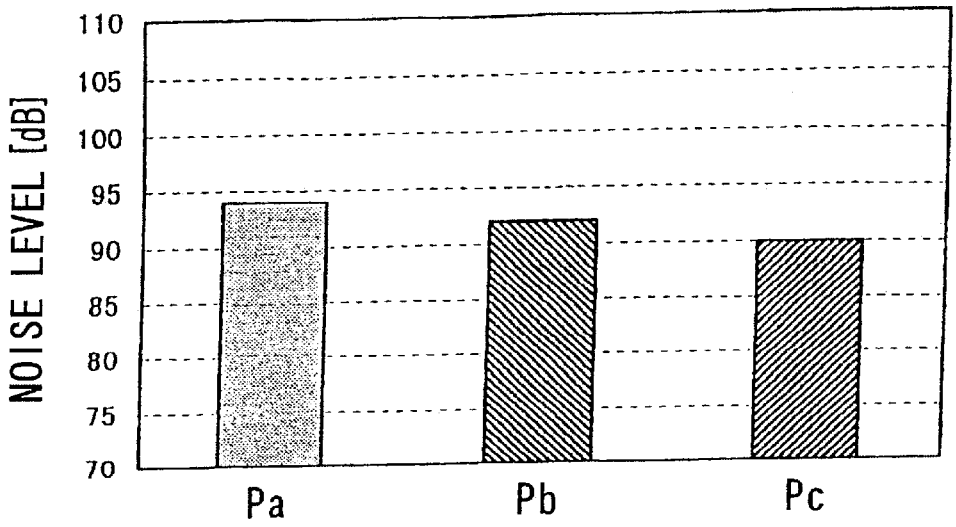
FIG. 14 is a graph showing the relationship between the shape of the inner pump cover discharge port and the noise generated by the pump.

Noise (dB) generated by operating the two fuel pumps of the first and second representative embodiment was measured and compared to noise generated by operating the known fuel pump described in Japanese Laid-Open Patent Publication No. 6-288381. FIG. 14 shows the measurement results, wherein Pa represents the noise level of the known fuel pump, Pb represents the noise level of the fuel pump of the second representative embodiment and Pc represents noise level of the fuel pump of the first representative embodiment. The ordinate represents the noise level in decibels (dB). The chamfered surface 24*e* of the fuel pump of the first embodiment was formed with a chamfering angle θ1 of 35°. As shown from FIG. 14, the fuel pump of the second representative embodiment was noticeably quieter than the known fuel pump and the fuel pump of the first embodiment was even quieter.

Figure 15:
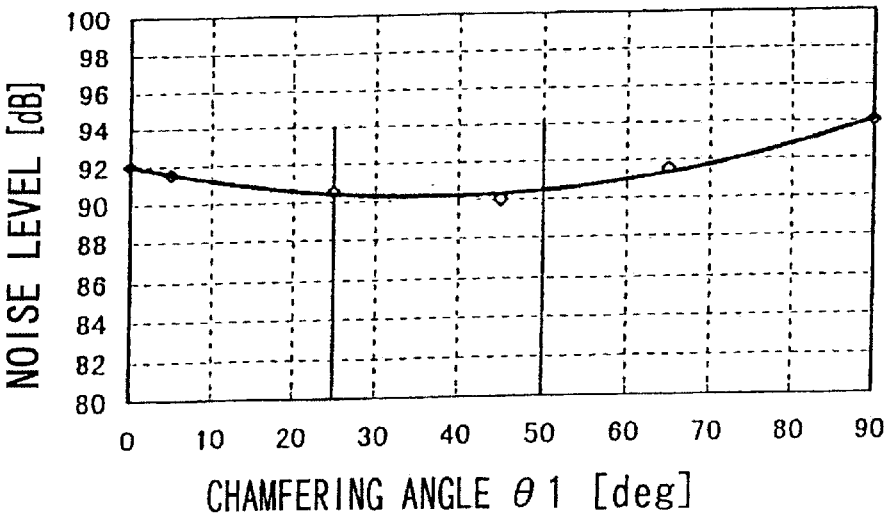
FIG. 15 is a graph showing the relationship between the chamfering angle of the inner pump cover discharge port and noise generated by the pump.

Further, the relationship between the chamfering angle θ1 of the chamfered surface 24*e* of the inner pump cover 9 and pump operating noise (dB) was measured for four fuel pump constructed with chamfered surfaces 24*e* according to the first representative embodiment. FIG. 15 shows the measurement results, in which the abscissa represents the chamfering angle θ1 and the ordinate represents the noise level (dB). As shown in FIG. 15, improved noise reduction can be obtained when the chamfering angle θ1 is between about 25° to 50°.

The present invention is not limited to the constructions that have been described as the representative embodiments, but rather, may be added to, changed, replaced with alternatives or otherwise modified without departing from the spirit and scope of the invention. For example, the application of the pump of the present invention is not limited to supply of vehicle fuel, but it may be used to supply a variety of fluids, such as water.

What is claimed is:

1. A regenerative type pump apparatus, including an impeller having a plurality of blade grooves formed along a perimeter of the impeller and a pump casing for rotatably housing the impeller, the pump casing having an inlet port, a discharge port, a passage groove extending from the inlet port to the discharge port along a traveling path of the blade grooves of the impeller, and a partition formed between the inlet port and the discharge port, wherein an opening end face of the discharge port on a side of the impeller has a width tapered portion and a damping portion, the width tapered portion having an opening width that gradually decreases along a direction of rotation of the impeller, and the damping portion being continuous with a downstream side of the width tapered portion and having an opening width that is substantially constant along the direction of rotation of the impeller.

2. An apparatus as set forth in claim 1, wherein a corner portion is defined by an intersection of the tapered portion, the damping portion and a surface of the inner pump cover that faces the impeller, the corner portion being chamfered.

3. An apparatus as set forth in claim 2, wherein the corner portion is chamfered at an angle of about 25° to 50°.

4. An apparatus as set forth in claim 3, wherein the chamfered angle is about 35°.

5. An apparatus as set forth in claim 3, wherein a front wall surface is formed within the discharge port and is forward in a direction of rotation of the impeller, the front wall surface comprising an oblique surface that forms an acute angle with a surface of the inner pump cover that faces the impeller.

6. An apparatus as set forth in claim 2, wherein a front wall surface is formed within the discharge port and is forward in a direction of rotation of the impeller, the front wall surface comprising an oblique surface that forms an acute angle with a surface of the inner pump cover that faces the impeller.

7. An apparatus as set forth in claim 6, wherein the discharge port has a rear wall surface located rearward in the direction of rotation of the impeller, the rear wall surface comprising an oblique surface that forms an acute angle with the surface of the inner pump cover that faces the impeller.

8. An apparatus as set forth in claim 2, wherein the discharge port has a rear wall surface located rearward in the direction of rotation of the impeller, the rear wall surface comprising an oblique surface that forms an acute angle with a surface of the inner pump cover that faces the impeller.

9. An apparatus as set forth in claim 1, wherein a front wall surface is formed within the discharge port and is forward in a direction of rotation of the impeller, the front wall surface comprising an oblique surface that forms an acute angle with a surface of the inner pump cover that faces the impeller.

10. An apparatus as set forth in claim 9, wherein the discharge port has a rear wall surface located rearward in the direction of rotation of the impeller, the rear wall surface comprising an oblique surface that forms an acute angle with the surface of the inner pump cover that faces the impeller.

11. An apparatus as set forth in claim 1, wherein the discharge port has a rear wall surface located rearward in the direction of rotation of the impeller, the rear wall surface comprising an oblique surface that forms an acute angle with a surface of the inner pump cover that faces the impeller.

12. A pump comprising:

a pump housing, a motor, an impeller having a plurality of blade grooves formed along a perimeter of the impeller, the impeller coupled to the motor, an outer pump housing cover having an inlet port in communication with a first circumferential groove formed in the outer pump cover and an inner pump housing cover having a discharge port in communication with a second circumferential groove formed in the outer pump cover, a partition is formed between an inlet groove portion of the second circumferential groove and the discharge port, wherein the inner pump cover and the outer pump cover are proximally disposed with the impeller rotatably supported between the inner pump cover and the outer pump cover, wherein a terminal end of the second circumferential groove is adjacent to the discharge port and the terminal end comprises a tapered portion and a damping portion, the tapered portion having an opening width that gradually decreases along a direction of rotation of the impeller, and the damping portion being contiguous with a downstream side of the tapered portion and having an opening width that is substantially constant along the direction of rotation of the impeller, wherein a front wall surface is formed within the discharge port and is forward in a direction of rotation of the impeller, the front wall surface comprising an oblique surface that forms an acute angle with a surface of the inner pump cover that faces the impeller and wherein the discharge port has a rear wall surface that is located rearward in the direction of rotation of the impeller, the rear wall surface comprising an oblique surface that forms an acute angle with the surface of the inner pump cover that faces the impeller.

13. A pump as set forth in claim 12, wherein a corner portion is defined by an intersection of the tapered portion, the damping portion and the surface of the inner pump cover that faces the impeller, wherein the corner portion is chamfered at an angle of about 25° to 50°.

14. A pump as set forth in claim 13, wherein the chamfered angle is about 35°.

* * * * *